US011292115B2

(12) United States Patent
Captarencu

(10) Patent No.: US 11,292,115 B2
(45) Date of Patent: Apr. 5, 2022

(54) STAPLE GUN CAPABLE OF UTILIZING MULTIPLE STAPLE SIZES

(71) Applicant: Klein Tools, Inc., Lincolnshire, IL (US)

(72) Inventor: Catalin Virgil Captarencu, Barrington, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 92 days.

(21) Appl. No.: 16/717,561

(22) Filed: Dec. 17, 2019

(65) Prior Publication Data

US 2021/0178566 A1 Jun. 17, 2021

(51) Int. Cl.
*B25C 5/16* (2006.01)
*B25C 5/11* (2006.01)

(52) U.S. Cl.
CPC ..... *B25C 5/1658* (2013.01); *B25C 5/11* (2013.01); *B25C 5/1606* (2013.01)

(58) Field of Classification Search
CPC ..... B25C 5/00; B25C 5/11; B25C 5/1606; B25C 5/1644; B25C 5/1651; B25C 5/1658; B25C 5/1662
USPC ..... 227/109, 120, 132
See application file for complete search history.

(56) References Cited

U.S. PATENT DOCUMENTS

| | | | | |
|---|---|---|---|---|
| 4,732,309 | A * | 3/1988 | Judge | B25C 5/1658 227/109 |
| 5,407,118 | A * | 4/1995 | Marks | B25C 5/11 227/132 |
| 5,556,020 | A * | 9/1996 | Hou | B25C 1/005 227/109 |
| 2002/0108996 | A1* | 8/2002 | Cornett | B25C 5/06 227/132 |
| 2008/0156844 | A1* | 7/2008 | Braganza | B25C 5/06 227/109 |

* cited by examiner

*Primary Examiner* — Valentin Neacsu
*Assistant Examiner* — Jacob A Smith

(57) ABSTRACT

A manually operated staple gun includes a frame, a staple magazine, and a user-actuated unit. The user-actuated unit is mounted in the frame to switch between a first condition wherein the magazine is configured to guide staples of a first width along a guide axis into a ready position to be driven into a work piece and a second condition wherein the magazine is configured to guide staples of a second width along the guide axis into the ready position to be driven into a work piece.

15 Claims, 15 Drawing Sheets

STAPLE GUN CAPABLE OF UTILIZING MULTIPLE STAPLE SIZES

CROSS-REFERENCE TO RELATED APPLICATIONS

None

BACKGROUND OF THE DISCLOSURE

The present disclosure relates fastening devices, and more particularly, to staple guns having staple magazines that can accommodate different widths of staples that are loaded as a collation of staples. While such staple guns are well known, there is always room for improvement. For example, one such commercially available staple gun requires that a component of the staple magazine be completely separated from the staple gun in order to load a collation of staples and further requires that another component be completely removed from the staple gun in order to reconfigure the staple gun to accommodate a different width of staples.

BRIEF SUMMARY OF THE DISCLOSURE

In accordance with one feature of this disclosure, a manually operated staple gun can carry a collation of staples and sequentially drive each of the staples of the collation in response to user actuation of the staple gun. The staple gun is capable of utilizing staples having different widths, with the widths being defined by a pair of spaced legs on each staple. The staple gun includes a frame, a staple magazine, and a user-actuated staple guide. The staple magazine is carried in the frame and is selectively configurable to receive a first collation of staples having a first width and a second collation of staples having a second width, the second width being greater than the first width. The user-actuated staple guide having a first pair of longitudinally extending guide surfaces to guide staples of the first width along a guide axis into a ready position to be driven into a work piece. The staple guide is mounted in the frame to move between a guiding position wherein the guide surfaces guide staples of the first width along the guide axis and a stowed position wherein the guide surfaces do not guide staple along the guide axis. The staple gun further includes a second pair of longitudinally extending guide surface to guide staples of the second width along the guide axis into the ready position to be driven into a work piece with the staple guide in the stowed position.

As one feature, the staple guide is u-shaped with a pair of legs defining the guide surfaces and a bridge joining the legs.

In one feature, each of the legs is a leaf-spring that can be deflected by a user from the guiding position to the stowed position.

According to one feature, the staple guide is pivot mounted to the frame at the bridge and the legs pivot between the guiding and stowed positions.

As one feature, the legs and the bridge are defined by a continuous length of cylindrical shaped material. In a further feature, the continuous length of material is a metallic wire that has been permanently deformed to define the legs and the bridge.

According to one feature, the staple gun further includes a user-actuated slide mounted to the frame to move between first and second positions. The staple guide further includes a foot extending from one of the legs and operably engaged with the slide to transmit an actuating force from the slide to the staple guide to actuate the staple guide between the guiding and stowed positions as the slide is moved between the first and second positions. As a further feature, the slide is mounted to the frame to translate between the first and second positions and the staple gun further includes a spring-biased detent that engages the slide in the first position to retain the slide in the first position.

In one feature, the staple guide is mounted to the frame to pivot between the guiding and stowed positions. In a further feature, the staple gun further includes a user-actuated slide mounted to the frame to move between first and second positions, and the slide operably engages the staple guide to transmit an actuating force to pivot the staple guide between the guiding and stowed positions as the slide is moved between the first and second positions. In yet a further feature, the slide is mounted to the frame to translate between the first and second positions.

As one feature, the staple gun further includes a user-actuated slide mounted to the frame to move between first and second positions and the slide is operably engaged with the staple guide to transmit an actuating force to move the staple guide between the guiding and stowed positions as the slide is moved between the first and second positions. In a further feature, the slide is mounted to the frame to translate between the first and second positions.

According to one feature, the second pair of guide surfaces extend parallel to the guide axis. In a further feature, the second pair of guide surfaces are defined by the frame.

In accordance with one feature of this disclosure, a manually operated staple gun can carry a collation of staples and sequentially drive each of the staples of the collation in response to user actuation of the staple gun. The staple gun is capable of utilizing staples having different widths, with the widths being defined by a pair of spaced legs on each staple. The staple gun includes a frame, a staple magazine, and a user-actuated unit. The staple magazine is carried in the frame and selectively configurable to receive a first collation of staples having a first width and a second collation of staples having a second width, with the second width being greater than the first width. The user-actuated unit mounted in the frame to switch between a first condition wherein the magazine is configured to guide staples of the first width along a guide axis into a ready position to be driven into a work piece and a second condition wherein the magazine is configured to guide staples of the second width along the guide axis into the ready position to be driven into a work piece. The user-actuated unit includes a user-actuated slide mounted to the frame to move between a first slide position and a second position. In the first position, the slide extends past a bottom surface of the staple gun to limit the depth to which staples of the first width can be driven into a work piece. In the second slide position, the slide is located to allow staples of the second width to be driven deeper into a work piece than the staples of the first width.

According to one feature, the user-actuated slide has a centering surface configured to engage a component of a predetermined size to center the staples of the first width relative to the component with the user-actuated slide in the first slide position to allow the component to be fastened to a work piece by the staples of the first width as they are driven into the work piece by the staple gun.

As one feature the user-actuated unit further includes a user-actuated staple guide having a pair of longitudinally extending guide surfaces. The staple guide is mounted in the frame to move between a guiding position wherein the guide surfaces guide staples of the first width along the guide axis and a stowed position wherein the guide surfaces do not guide staple along the guide axis. The staple guide is operably connected to the user-actuated slide to move between the guiding and stowed positions in response to the slide moving between the first and second slide positions.

In one feature, the staple guide is u-shaped with a pair of legs defining the guide surfaces and a bridge joining the legs, each of the legs being a leaf-spring that can be deflected by a user from the guiding position to the stowed position.

According to one feature, the staple guide is u-shaped with a pair of legs defining the guide surfaces and a bridge joining the legs, the staple guide being pivot mounted to the frame at the bridge so that the legs pivot between the guiding position and stowed position.

In one feature, the slide is mounted to the frame to translate between the first and second positions and the staple gun further includes a spring-biased detent that engages the slide in the first position to retain the slide in the first position.

In accordance with one feature of this disclosure, a manually operated staple gun is provided and is capable of utilizing staples having different widths, with the widths being defined by a pair of spaced legs on each staple. The staple gun includes a frame, a user-actuated grip, a staple driving mechanism, a staple magazine, and a user-actuated staple guide. The user-actuated grip is mounted to the frame to move in response to an actuating force applied to the grip by a user's hand. The staple driving mechanism is carried in the frame and is operably connected to the grip to drive a staple in response to the grip being actuated by a user. The staple magazine is carried in the frame and is selectively configurable to receive a first collation of staples having a first width and a second collation of staples having a second width, the second width being greater than the first width. The user-actuated staple guide having a first pair of longitudinally extending guide surfaces to guide staples of the first width along a guide axis into the staple driving mechanism to be driven into a work piece. The staple guide is mounted in the frame to move between a guiding position wherein the guide surfaces guide staples of the first width along the guide axis and a stowed position wherein the guide surfaces do not guide staple along the guide axis. The staple gun further includes a second pair of longitudinally extending guide surface to guide staples of the second width along the guide axis into the driving mechanism to be driven into a work piece with the staple guide in the stowed position.

In accordance with one feature of this disclosure, a manually operated staple gun is provided and is capable of utilizing staples having different widths, with the widths being defined by a pair of spaced legs on each staple. The staple gun includes a frame, a user-actuated grip, a staple driving mechanism, a staple magazine, and a user-actuated staple guide. The user-actuated grip is mounted to the frame to move between a ready position and a release position in response to an actuating force applied to the grip by a user's hand. The staple driving mechanism is carried in the frame and is operably connected to the grip to drive a staple in response to the grip being actuated from the ready position to the release position. The staple magazine is carried in the frame and is selectively configurable to receive a first collation of staples having a first width and a second collation of staples having a second width, the second width being greater than the first width. The user-actuated staple guide having a first pair of longitudinally extending guide surfaces to guide staples of the first width along a guide axis into the staple driving mechanism to be driven into a work piece. The staple guide is mounted in the frame to move between a guiding position wherein the guide surfaces guide staples of the first width along the guide axis and a stowed position wherein the guide surfaces do not guide staple along the guide axis. The staple gun further includes a second pair of longitudinally extending guide surface to guide staples of the second width along the guide axis into the driving mechanism to be driven into a work piece with the staple guide in the stowed position.

In accordance with one feature of this disclosure, a manually operated staple gun is provided and is capable of utilizing staples having different widths, with the widths being defined by a pair of spaced legs on each staple. The staple gun includes a frame, a user-actuated grip, a staple driving mechanism, a staple magazine, and a user-actuated unit. The user-actuated grip is mounted to the frame to move in response to an actuating force applied to the grip by a user's hand. The staple driving mechanism is carried in the frame and is operably connected to the grip to drive a staple in response to the grip being actuated by a user. The staple magazine is carried in the frame and selectively configurable to receive a first collation of staples having a first width and a second collation of staples having a second width, with the second width being greater than the first width. The user-actuated unit mounted in the frame to switch between a first condition wherein the magazine is configured to guide staples of the first width along a guide axis into the driving mechanism to be driven into a work piece and a second condition wherein the magazine is configured to guide staples of the second width along the guide axis into the driving mechanism to be driven into a work piece. The user-actuated unit includes a user-actuated slide mounted to the frame to move between a first slide position and a second position. In the first position, the slide extends past a bottom surface of the staple gun to limit the depth to which staples of the first width can be driven into a work piece. In the second slide position, the slide is located to allow staples of the second width to be driven deeper into a work piece than the staples of the first width.

In accordance with one feature of this disclosure, a manually operated staple gun is provided and is capable of utilizing staples having different widths, with the widths being defined by a pair of spaced legs on each staple. The staple gun includes a frame, a user-actuated grip, a staple driving mechanism, a staple magazine and a user-actuated unit. The user-actuated grip is mounted to the frame to move between a ready position and a release position in response to an actuating force applied to the grip by a user's hand. The staple driving mechanism is carried in the frame and is operably connected to the grip to drive a staple in response to the grip being actuated from the ready position to the release position. The staple magazine is carried in the frame and selectively configurable to receive a first collation of staples having a first width and a second collation of staples having a second width, with the second width being greater than the first width. The user-actuated unit mounted in the frame to switch between a first condition wherein the magazine is configured to guide staples of the first width along a guide axis into the driving mechanism to be driven into a work piece and a second condition wherein the magazine is configured to guide staples of the second width along the guide axis into the driving mechanism to be driven into a work piece. The user-actuated unit includes a user-actuated slide mounted to the frame to move between a first slide position and a second position. In the first position, the slide extends past a bottom surface of the staple gun to limit the depth to which staples of the first width can be driven into a work piece. In the second slide position, the slide is located to allow staples of the second width to be driven deeper into a work piece than the staples of the first width.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
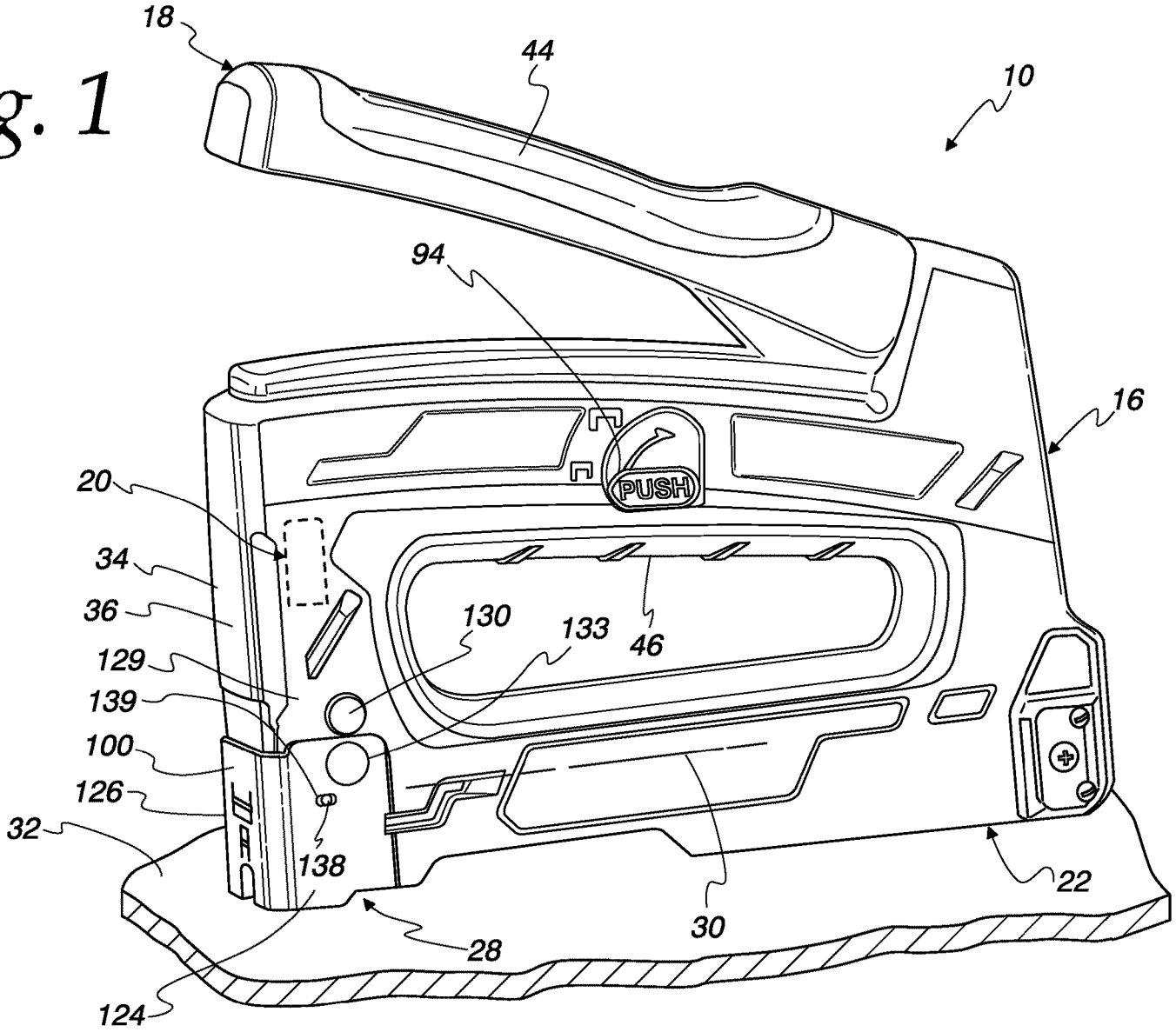
FIG. 1 is a perspective view from the left-front of a staple gun according to this disclosure, with the staple gun in a first condition.
Figure 2:
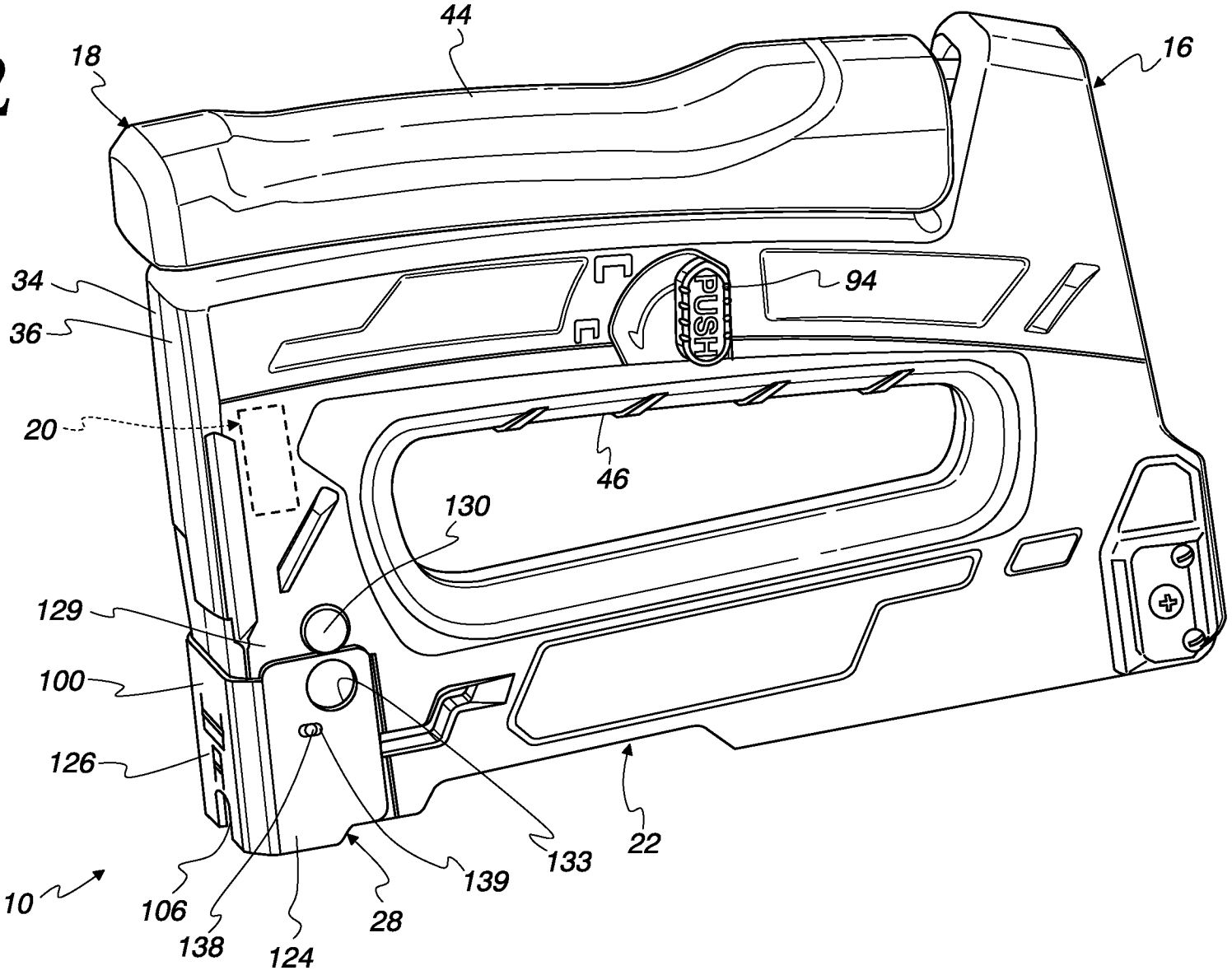
FIG. 2 is a view similar to FIG. 1 but showing the staple gun in a second condition.

As best seen in FIGS. 1-4B, a manually operated staple gun 10 is shown and is capable of selectively utilizing staples 12 having different widths W, as defined by the spaced legs 14 on each staple 12. As best seen in FIGS. 1 and 2, the staple gun 10 includes a frame/housing 16, a user-actuated grip 18, a staple driving mechanism 20 (shown schematically in FIGS. 1 and 2), and a staple magazine 22. The grip 18 is mounted to the frame 16 to move between a ready position, shown in FIG. 1, and a release position, shown in FIG. 2, in response to an actuating force applied to the grip 18 by a user's hand. The staple driving mechanism 20 is carried in the frame 16 and operably connected to the grip 18 to drive a staple 12 in response to the grip 18 being actuated from the ready position to the release position.

Figure 3B:
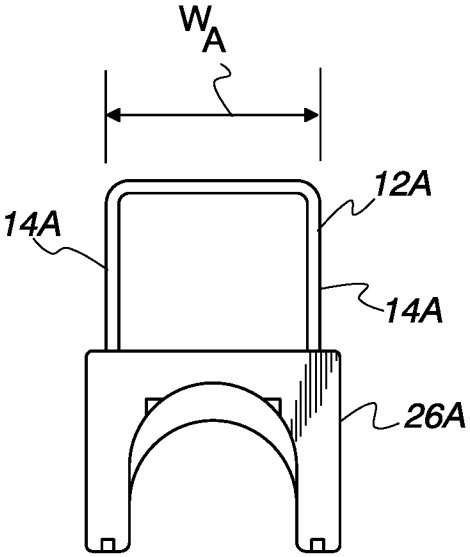
FIG. 3B is a front elevation of a staple of the collation of FIG. 3A.
Figure 3A:
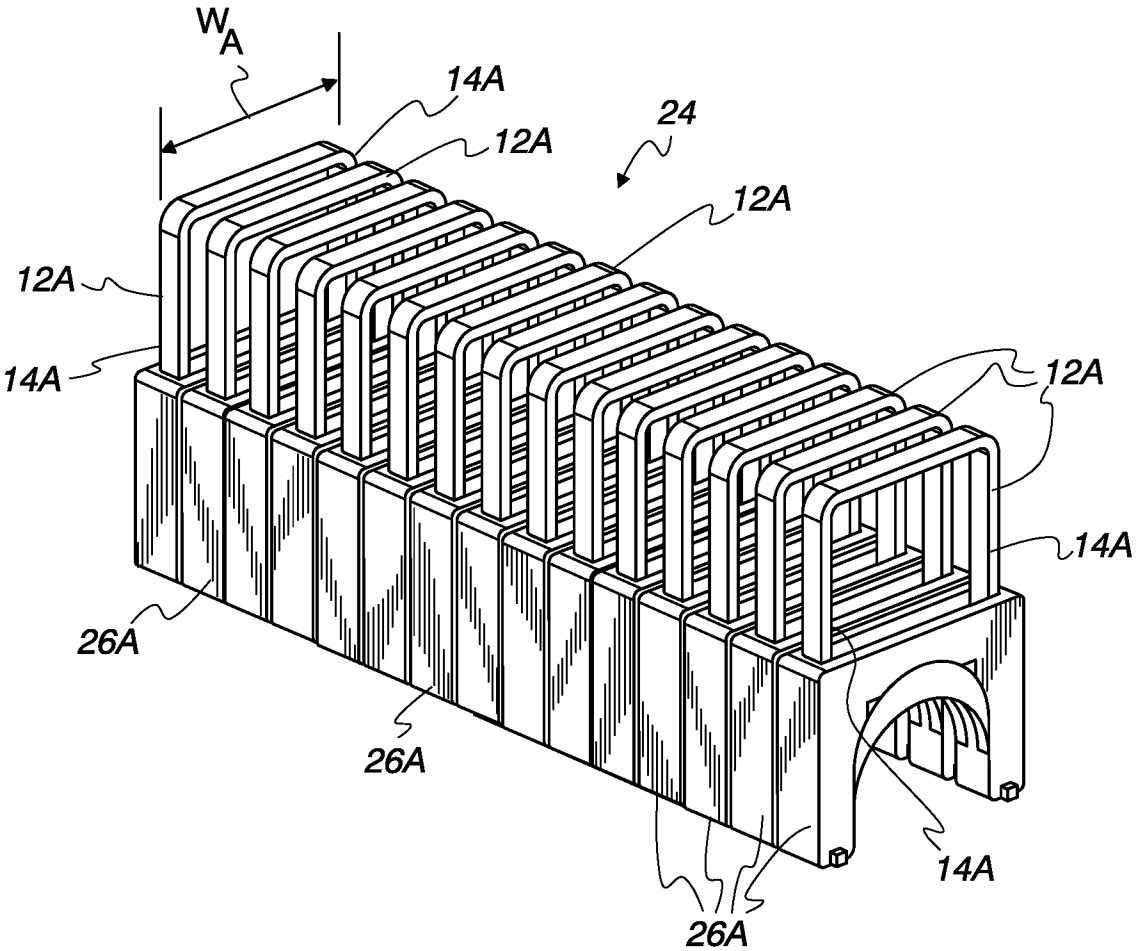
FIG. 3A is a perspective view of a collation of staples for use in the staple gun according to this disclosure.
Figure 4B:
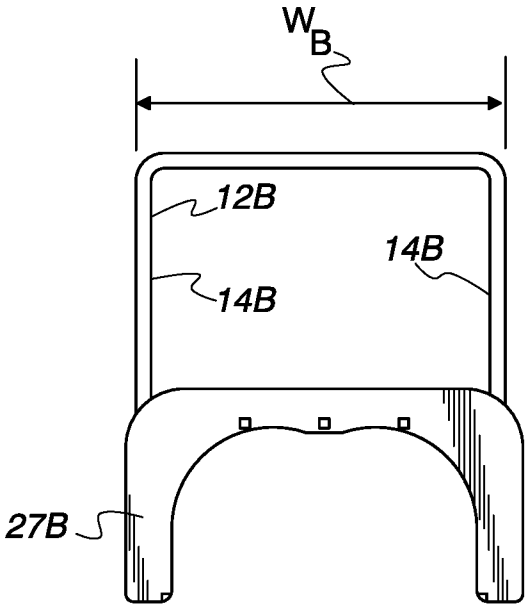
FIG. 4B is a front elevation of a staple of the collation of FIG. 4A.
Figure 4A:
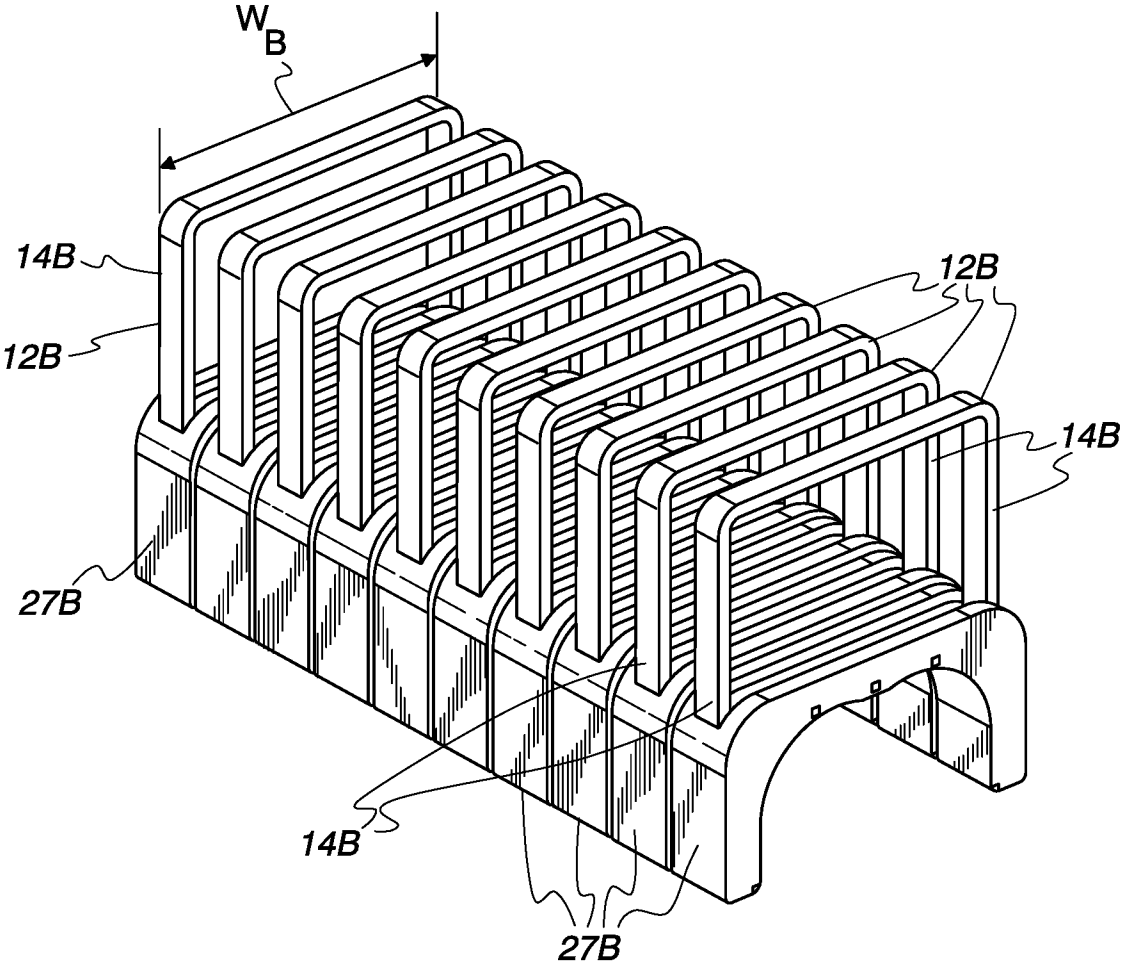
FIG. 4A is a perspective view of another collation of staples for use in the staple gun according to this disclosure having a width that is greater than the width of the staples shown in FIGS. 3A and 3B.
Figure 5:
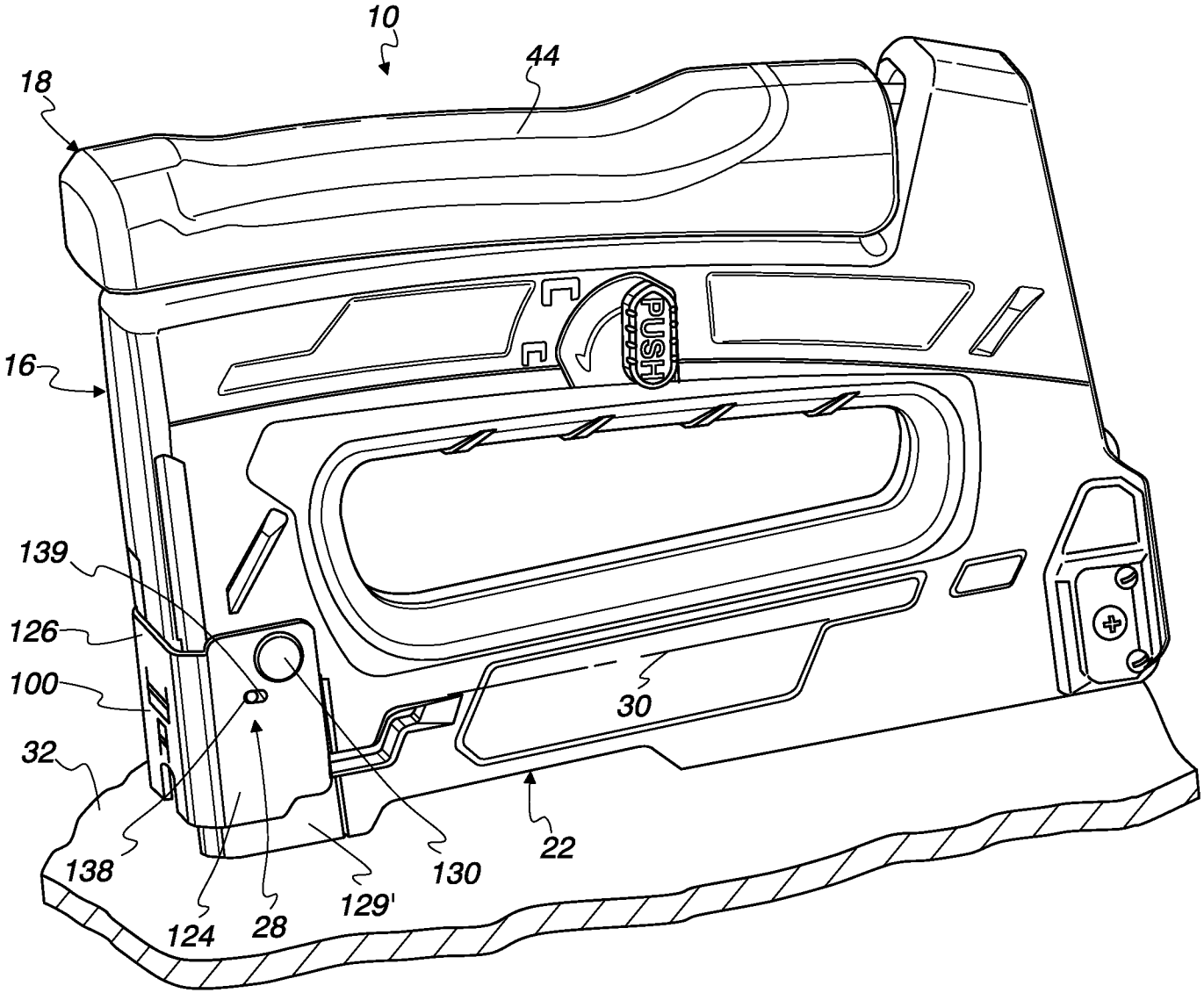
FIG. 5 is a view similar to FIGS. 1 and 2, but showing the staple gun in another condition.
Figure 6:
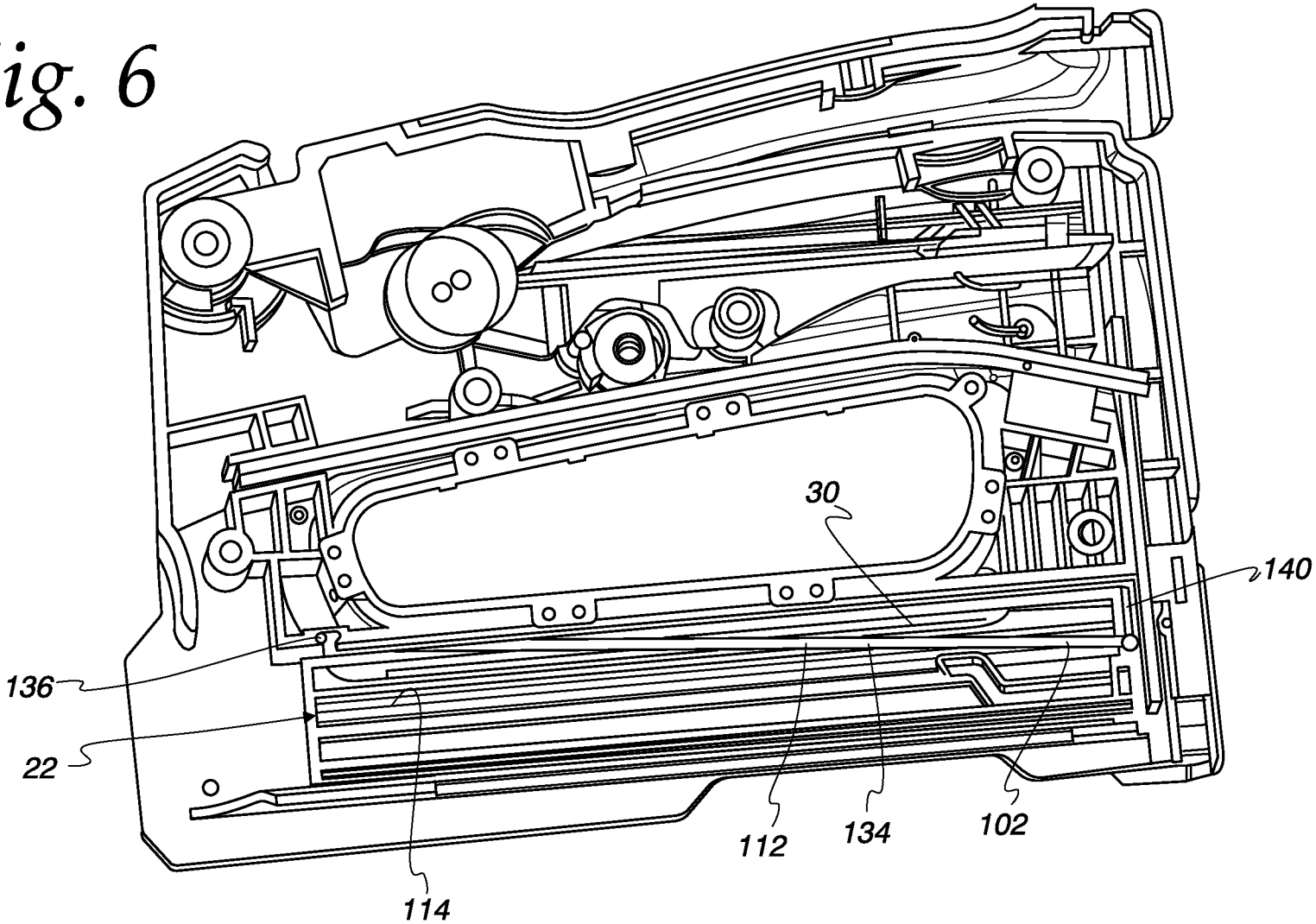
FIG. 6 is perspective view of the staple gun of FIGS. 1, 2, and 5 showing a staple guide in a guiding position and with a number of components removed and/or shown in section for purposes of illustration.
Figure 7:
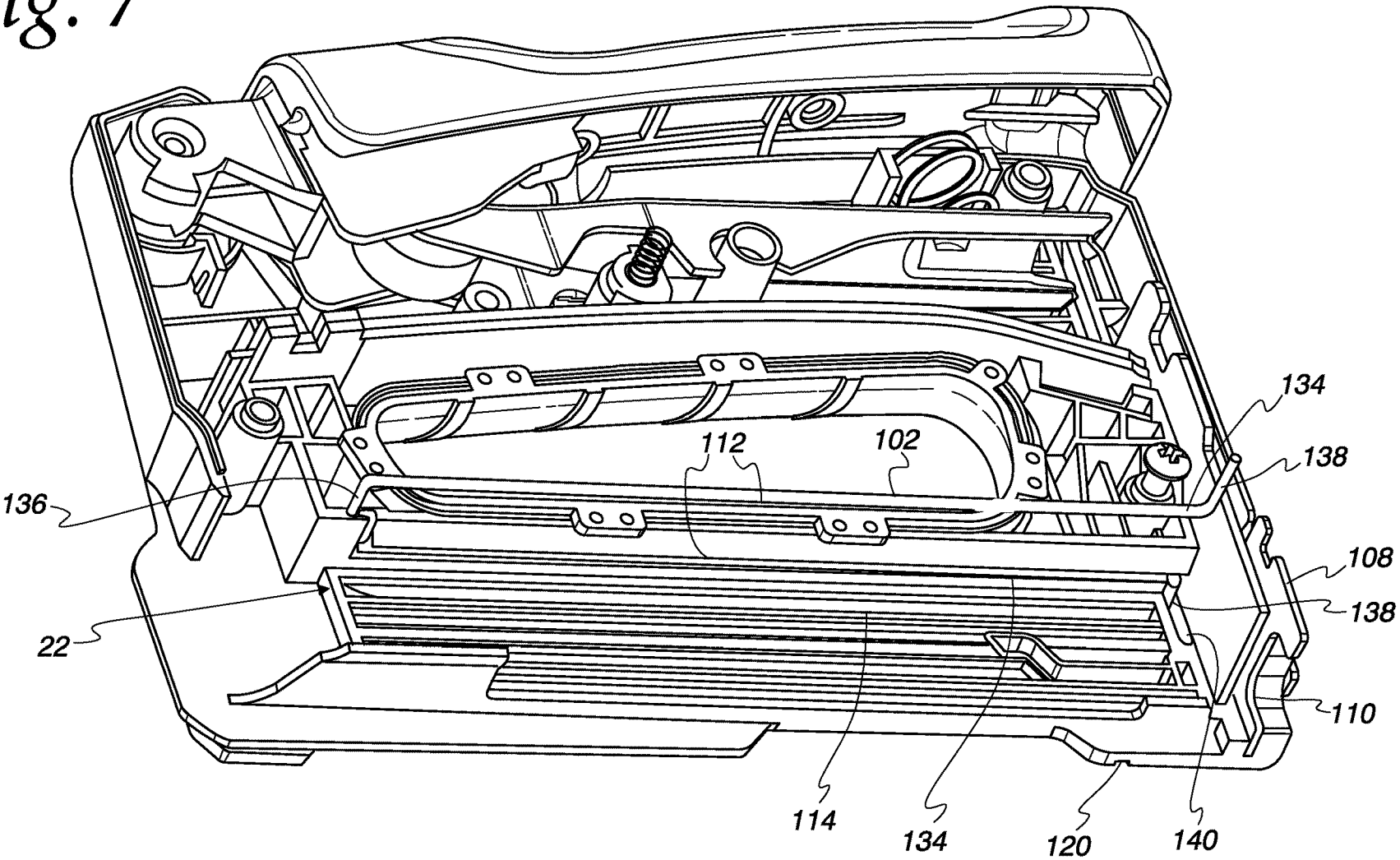
FIG. 7 is a view similar to FIG. 6 but showing the staple guide in a stowed position.

The staple magazine 22 is carried by the frame 16 and is selectively configurable to receive a first collation 24A of staples 12A having a first width $W_A$, shown in FIGS. 3A and 3B, and a second collation 24B of staples 12B having a second width $W_B$, shown in FIGS. 4A and 4B, with the second width $W_B$ being greater than the first width $W_A$. In the illustrated embodiments, each of the legs 14 of each staple 12 is held in a u-shaped insulator 26, with each insulator 26 in the collation 24 being joined to adjacent insulators 26 by frangible connections, as is known for staples used to hold electrical wires and cable. The staple gun 10 further includes a user-actuated unit 28 mounted to the frame 16 to switch between a first condition shown in FIGS. 1 and 2, and a second condition shown in FIG. 5. As best seen in FIGS. 1 and 6, in the first condition, the magazine 22 is configured to guide the staples 12A of the first width $W_A$ along a guide axis 30 into a ready position to be driving into a work piece 32. As best seen in FIGS. 5 and 7, in the second condition, the magazine 22 is configured to guide the staples 12B of the second width $W_B$ along the guide axis 30 into the ready position to be driving into a work piece 32.

As best seen in FIG. 1, the frame 16 of the illustrated embodiment includes a right side component 34 and a left side component 36 that each define about one-half of the frame 16. In the illustrated embodiment, the components 34 and 36 are joined together with a plurality of suitable threaded fasteners (not shown). The components 34 and 36 are from a suitable material and in the illustrated embodiment are metal castings.

Figure 8:
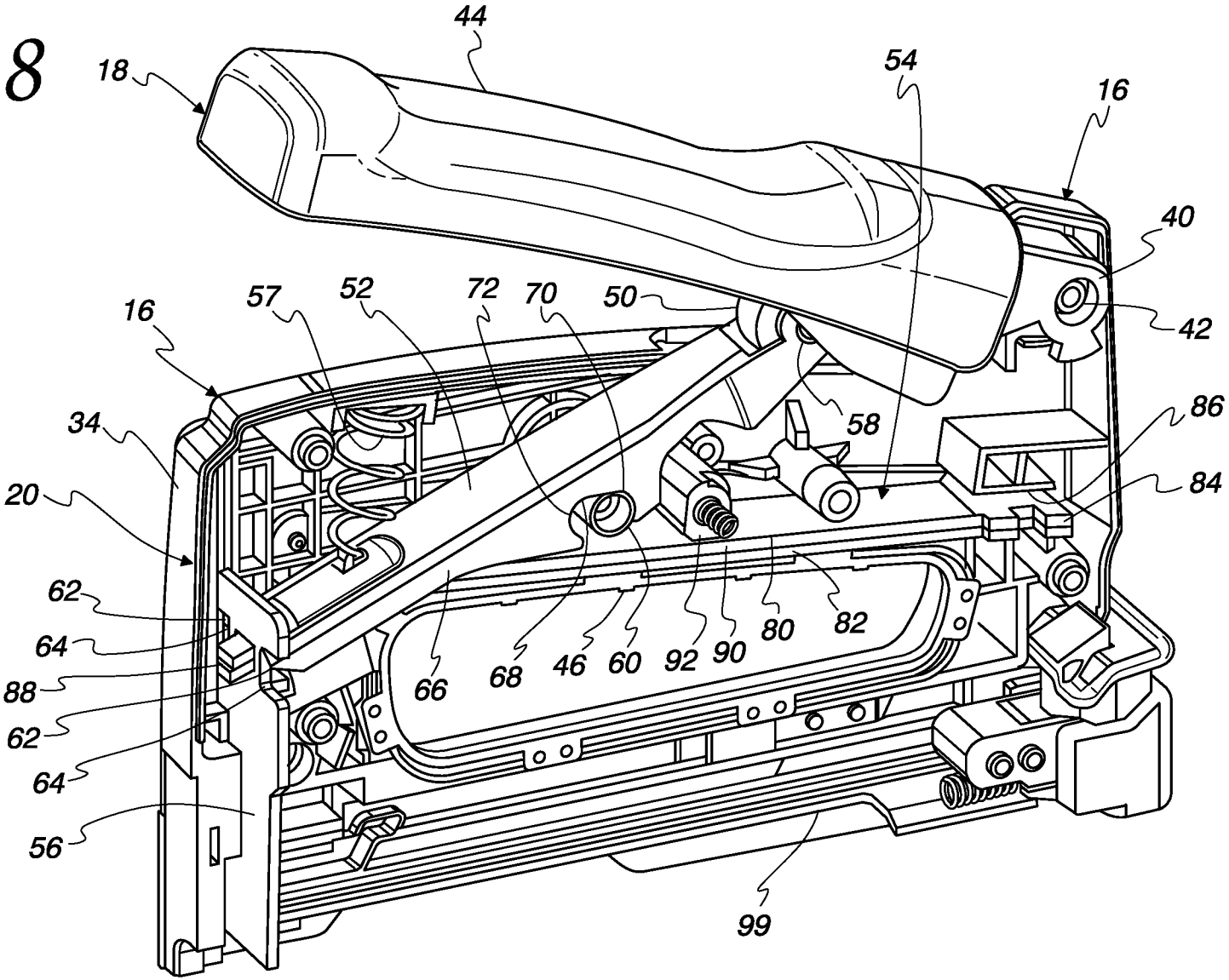
FIG. 8 is a perspective view of the staple gun in the condition shown in FIG. 1, but with a number of components removed for purposes of illustration.
Figure 9:
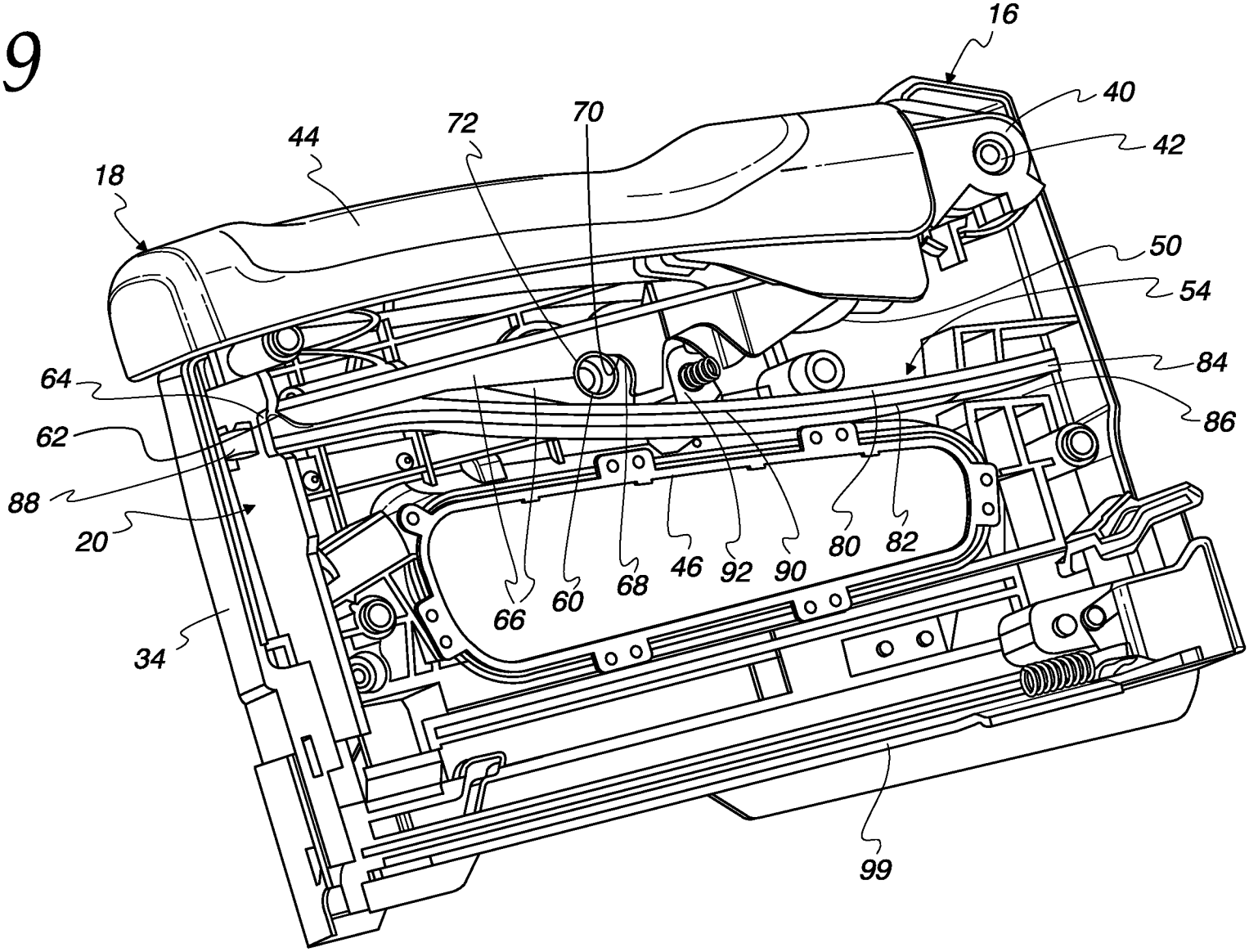
FIG. 9 is a view similar to FIG. 8 but showing the staple gun in the condition shown in FIG. 2.

As best seen in FIGS. 8 and 9, the grip 18 includes an end 40 pivot mounted to a stationary axle 42 on the frame 16. The grip further includes a hand engagement portion 44 that is configured to be engaged by a palm of a user with the users fingers engaged against a surface 46 on the frame 16 to allow the user to pivot the grip 18 from the ready position shown in FIG. 8 to the release position shown in FIG. 9. The grip 18 also includes a cam surface (not shown) that engages a cam follower 50 of the driving mechanism 20 to transmit an actuating force from the grip 18 to the driving mechanism 20.

The driving mechanism 20 includes the cam follower 50, a lever arm 52, a drive spring 54, a punch 56, and a return spring 57. The cam follower 50 is mounted for rotation about an axle 58 on one end of the lever arm 52. The lever arm 52 is mounted in the frame 16 to move from a ready position shown in FIG. 8 to a release position shown in FIG. 9. The punch 56 is mounted in the frame 16 to translate from a first position shown in FIG. 8 to a second position shown in FIG. 9 as the lever arm moves from the ready position to the release position. The drive spring 54 is configured to store potential energy as the lever arm 52 moves from the ready position to the release position and then to transform that energy into kinetic energy that drives the punch 56 from the second position to the first position. The return spring 57 is engaged between the frame 16 and the lever arm 52 to bias the lever arm 52 and the grip 18 to their ready positions.

The lever arm 52 pivots about a pivot axle 60 on the frame 16 and includes a pair of end fingers 62 that selectively engage and disengage from openings 64 in the punch 56 as the lever arm 52 moves from the ready position to the release position. The lever arm 52 includes a pair of longitudinally extending sidewalls 66 with each sidewall 66 having a cam surface 68 that engages the pivot axle 60. The cam surfaces 68 combine with the cam surface on the grip 18 to shift or translate the lever 52 from a ready pivot location defined by a first semi-circular surface 70 on each cam surface 68 to a release pivot location defined by a second semi-circular surface 72 on each cam surface 68. The shift/translation of the lever 52 from the ready pivot location to the release pivot location pulls the fingers 62 out of engagement with the openings 64 in the punch 56 and allow the drive spring 54 to transform its potential energy into kinetic energy in the punch 56.

The drive spring 54 is provided in the form of a leaf spring 54 formed from a stacked pair of spring elements 80 and 82. The drive spring 54 has one end 84 fixed in a slot 86 on the frame 16 and an opposite end 88 that is received in an opening in the punch 56, with a middle portion 90 that is engaged against a bend cam 92 mounted in the frame 16. The bend cam 92 can be pivoted relative to the frame 16 and the spring 54 by a user to change the amount of deflection produced in the spring 54 as the grip 18 and lever 52 move from their ready positions to their release positions. In this regard, as best seen in FIGS. 1 and 2, a user actuated lever 94 is can be engaged with the bend cam 92 to rotated the cam 92 between first deflection position shown in FIG. 1 and second deflection position shown in FIG. 2.

Figure 10:
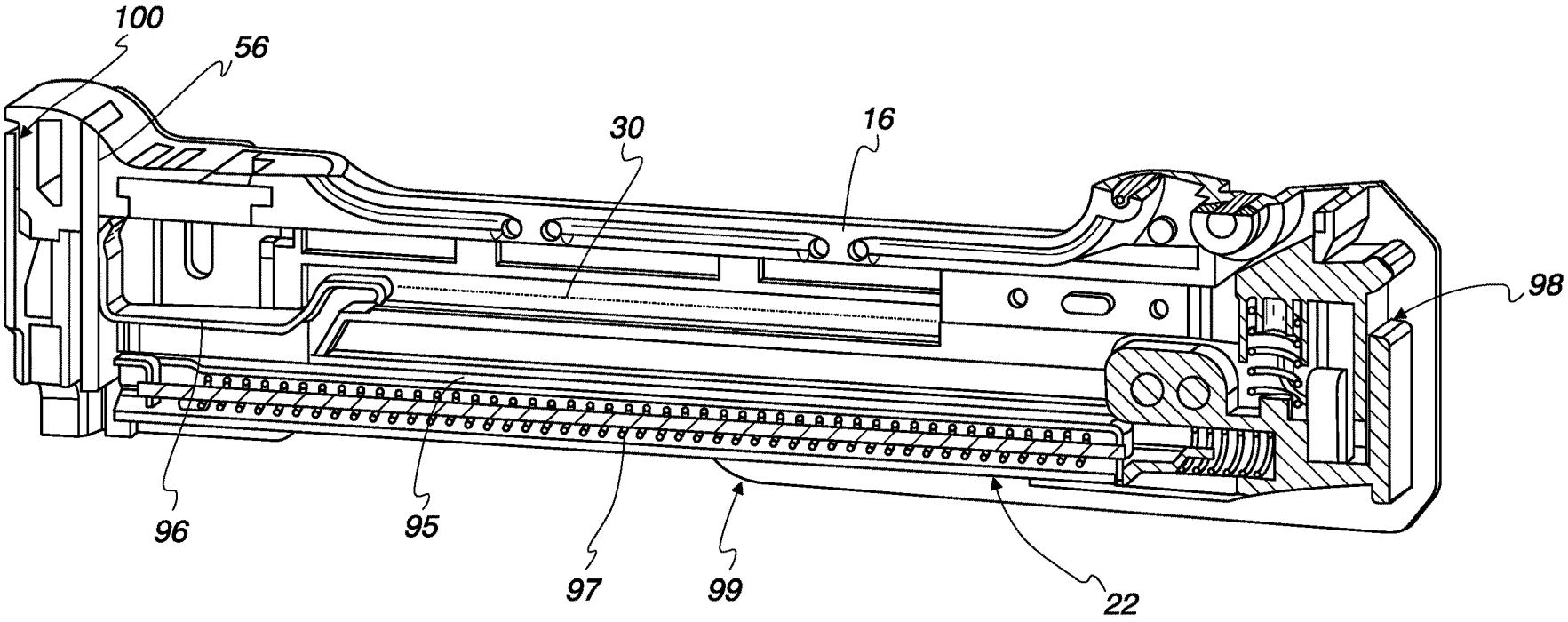
FIG. 10 is a sectioned, perspective view showing several components of the staple gun, but with an upper portion broken away and selected components not shown for purposes of illustration.
Figure 11:
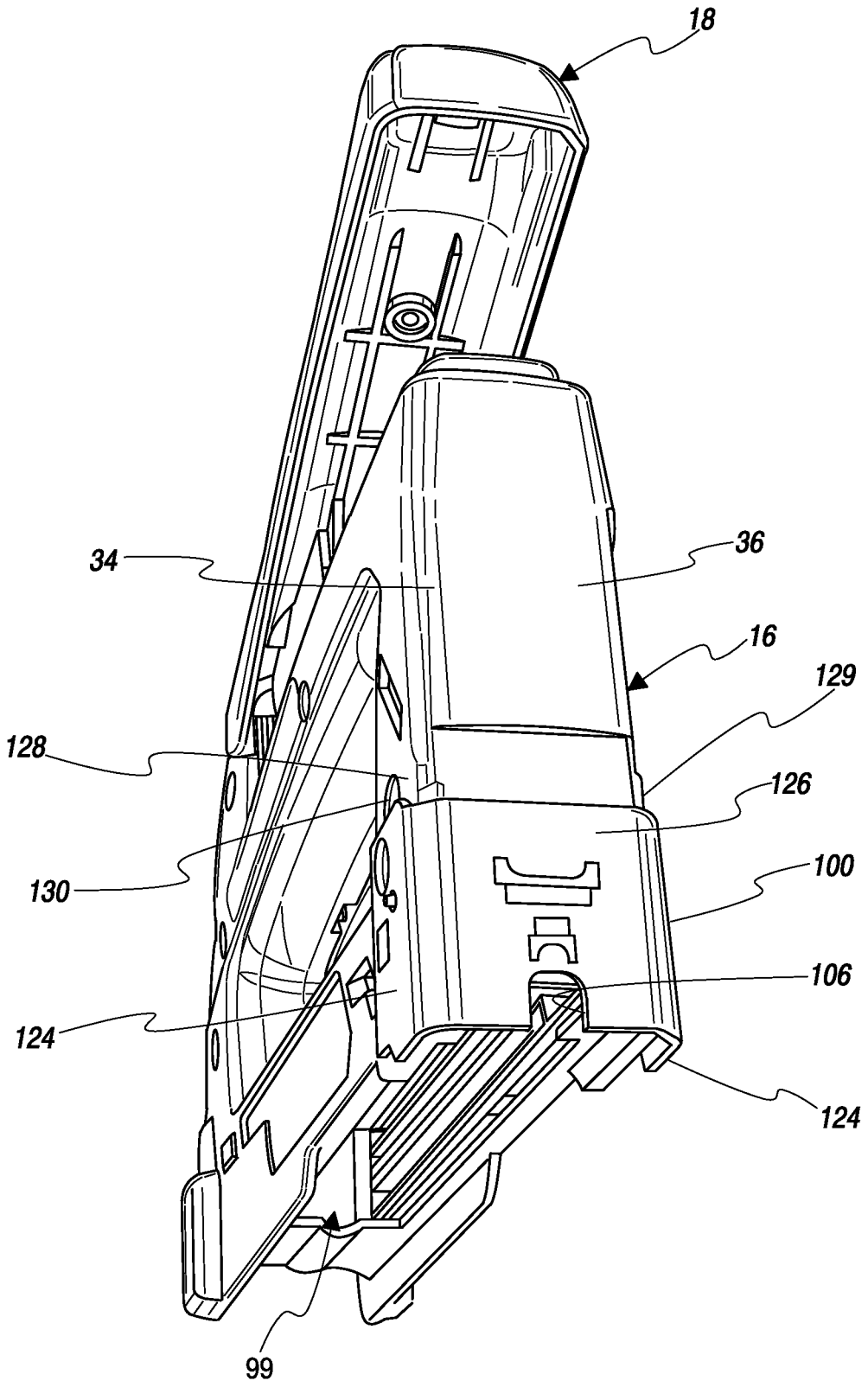
FIG. 11 is a perspective view from below and to the right-front of the staple gun of FIGS. 1, 2, and 5-10.

As shown in FIG. 10, the magazine 22 includes an elongate guide track 95, a staple push structure 96, a helical compression spring 97, and a releasable connector unit 98. The guide track 95 extends parallel to the guide axis 30 and is configured to be slidably received in the frame 16 to translate from a loading position that allows a collation 24 of staples 12 to be loaded into the magazine 22 and a loaded position wherein a collation 24 of staples 12 are retained in the magazine to be sequentially loaded into the driving mechanism to be driven into a work piece. In this regard and as best seen in FIG. 11, the frame 16 includes an elongate opening 99 in the bottom of the staple gun 10 to allow a collation 24 of staples 12 to be loaded into the magazine 22 with the track 95 in the loading position and still retained in the frame. The push structure 96 is mounted on the guide track 95 for guided sliding translation along the guide axis 30 relative to the track 95. The spring 97 is mounted to bias the push structure 96 toward the punch 56 with sufficient force to sequentially push each staple 12 in a collation 24 into a ready position in the driving mechanism 20 with the track 95 in the loaded position. The releasable connector unit 98 is configured to releasably retain the track 95, the push structure 96 and the spring 97 in the loaded position in the frame 16 shown in FIG. 10.

In operation, a user forces the grip 18 from the ready to the release position by engaging the grip 18 with the palm of their hand while grasping the surface 46 with their finger and applying a force to the hand engagement portion 44 in the direction of the frame 16. As the grip 18 moves toward the release position, the cam surface 48 transfers an actuating force to the lever arm 52 via the cam follower 50 that pivots the lever arm 52 about the first pivot location from the ready position toward the release position of the lever arm 52. The lever arm 52 transfers the actuation force to the punch 56 to translate the punch 56 from its first position to its second position. The movement of the punch 56 towards its second position bends the drive spring 54 against the bend cam 92, thereby inputting potential energy into the drive spring 54, and allows for a staple 12 to be forced into a loaded position by the staple magazine 22. When the cam follower 50 passes the transition 78 on the cam surface 48, the cam surfaces 48 and 68 combine to shift the lever arm 52 from the first pivot location to the second pivot location, thereby pulling the fingers 62 from the openings 64 and releasing the punch 56. When the punch 56 is released, the potential energy stored in the drive spring 54 is transformed into kinetic energy in the punch 56 as the drive spring 54 forces the punch 56 from the second position to the first position. The punch 56 transfers the energy to the staple 12 in the ready position as the punch 56 is forced from the second position to the first position, thereby driving the staple 12 into a work piece. After a staple 12 is driven from the ready position into a work piece, the spring 97 forces the push structure 96 to load the next staple 12 in the collation 24 into the ready position. When a user wishes to load a new collation 24, the user releases the connector unit 98, slides the track 95 to the loading position, loads a new collation 24 through the opening 99, and then slides the track 95 back to the loaded position where the connector unit 98 engages the frame 16 to retain the track in the loaded position.

It should be understood that while highly preferred embodiments have been shown for the components/features/configurations of the grip 18, the driving mechanism 20, and the magazine 22, and for the related features of the frame 16, the disclosed user-actuated unit 28 discussed below can be used with any suitable construction/configurations and associated components for the frame 16, grip 18, the driving mechanism 20, and magazine 22, many of which are known, and that no limitation to a specific construction/configuration of such components is intended unless expressly recited in an appended claim.

As best seen in FIGS. 1, 2, and 5-7, in the illustrated and preferred embodiments, the user-actuated unit 28 includes a user-actuated slide 100 and a user-actuated staple guide 102. In the illustrated embodiment, the user-actuated slide 100 is mounted to the frame 16 to move between a first slide position, best seen in FIGS. 1 and 2, and a second slide position best seen in FIG. 5. In the first position, the slide 100 extends past a bottom surface 104 of the frame 16 to limit the depth to which a staple 12A of the first width $W_A$ can be driven into a work piece. In the second slide position, the slide 100 is located to allow staples 12B of the second width $W_B$ to be driven deeper into a work piece. In this regard, in the illustrated embodiment and as best seen in FIG. 5, the slide 100 is located in the second slide position so that it does not extend past the bottom surface 104 of the frame 16, which allows the punch 56 to drive a staple 12B deeper into a work piece. In the illustrated embodiment and as best seen in FIG. 11, the slide 100 also includes a centering surface 106 that is configured to engage a component, typically a wire cover, of a first predetermined size and shape to center the staples 12A of the first width $W_A$ relative to the component with the slide 100 in the first position. Similarly, in the illustrated embodiment and has best seen in FIG. 7, the staple gun includes a guide member 108 that has another centering surface 110 that is configured to engage a component, again typically a wire cover, of second predetermined size and shape, larger than the first predetermined size, to center the staples 12B of the second width $W_B$ relative to the component with the slide 100 in the second position.

The staple guide 102 include a pair of longitudinally extending guide surfaces 112 (only one shown in FIG. 6) and is mounted to the frame 16 to move between a guiding position shown in FIG. 6 and a stowed position shown in FIG. 7. In the guiding position, the guide surfaces 112 guide staples 12A of the first width $W_A$ along the guide axis 30 into the ready position. In the stowed position, the guide surfaces 112 do not guide the staples 12A along the guide axis 30. In the illustrated embodiment, the frame 16 includes another pair of longitudinally extending guide surfaces or walls 114 (only one shown in FIGS. 6 and 7), with one of the walls 114 defined in the right side component 34 and the other of the walls 114 defined in the in left side component 36. The surfaces/walls 114 guide staples 12B of the second width $W_B$ along the guide axis 30 into the loaded position in the driving mechanism when the staple guide 102 is in the stowed position. The staple guide 102 is operably connected to the slide 100 to move between the guiding position and the stowed position in response to the slide 100 moving between the first and second slide positions.

In the illustrated embodiment, the slide 100 is mounted to the frame 16 to translate between the first and second slide positions. In this regard, each component 34 and 36 can include a linear guide channels that receives a corresponding elongate rail formed on the slide 100 for guided translation of the slide 100 relative to the frame 16. The rails can extend inwardly from a pair of parallel sidewalls 124 of the slide 100 that are joined together by a front wall 126 of the slide 100. The walls 124 and 126 have a sliding fit with surfaces 128 and 129, respectively, on the frame 16. In the illustrated embodiment, the each component 34 and 36 of the frame 16 mounts a spring-loaded detent 130 that is biased outwardly from the corresponding surface 128 129 by a spring to engage against the corresponding sidewall 124 to retain the slide 100 in the first position. The detents 130 can be pressed inwardly against the spring load by a user to disengage the detents 130 from the sidewalls 124 thereby allowing the user to translate the slide 100 from the first slide position to the second slide position. The spring 132 automatically move the detents 130 into engagement with the sidewalls 124 when a user moves the slide 100 from the second slide position to the first slide position. In the embodiment of FIGS. 1, 2, and 5-11, each sidewall 124 includes an opening 133 sized to receive the corresponding detent 130 when the slide 100 is in the second position.

Figure 12:
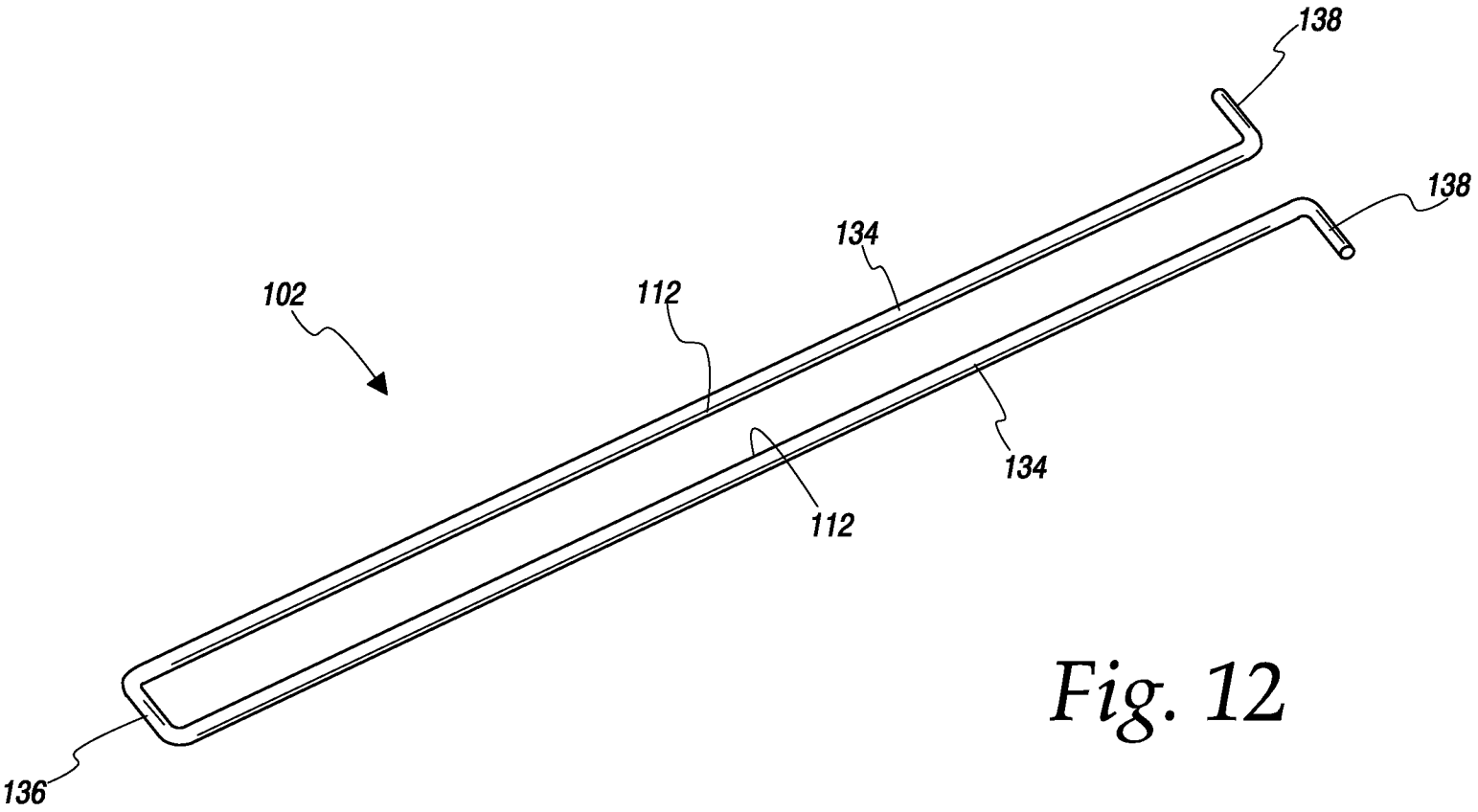
FIG. 12 is a perspective view showing a staple guide used in the staple gun of FIGS. 1, 2, and 5-11.

As best seen in FIG. 12, one highly preferred embodiment of the staple guide 102 is u-shaped with a pair of legs 134 defining the guide surfaces 112 and a bridge 136 joining the legs 134, with the legs 134 and bridge 136 being defined by a single continuous piece of material. In the embodiment shown in FIGS. 1, 2, and 5-11, the staple guide 102 is pivot mounted to the frame 16 so that the legs 134 pivot between the guiding and stowed positions. In the illustrated embodiment, the legs 134 and the bridge 136 are formed from an elongate cylindrical wire, with the bridge 136 being pivot mounted in a slot formed in the frame 16. As best seen in FIG. 12, each of the legs 134 of the embodiment shown in FIG. 1-*n* include a foot 138 that engages an opening 139 in the slide 100 by extending through an elongate slot 140 in the frame 16. This engagement transmits an actuation force from the slide 100 to the each of the legs 134 to pivot the legs between the guiding position and the stowed position as a user translates the slide 100 between the first position and the second position.

Figure 13:
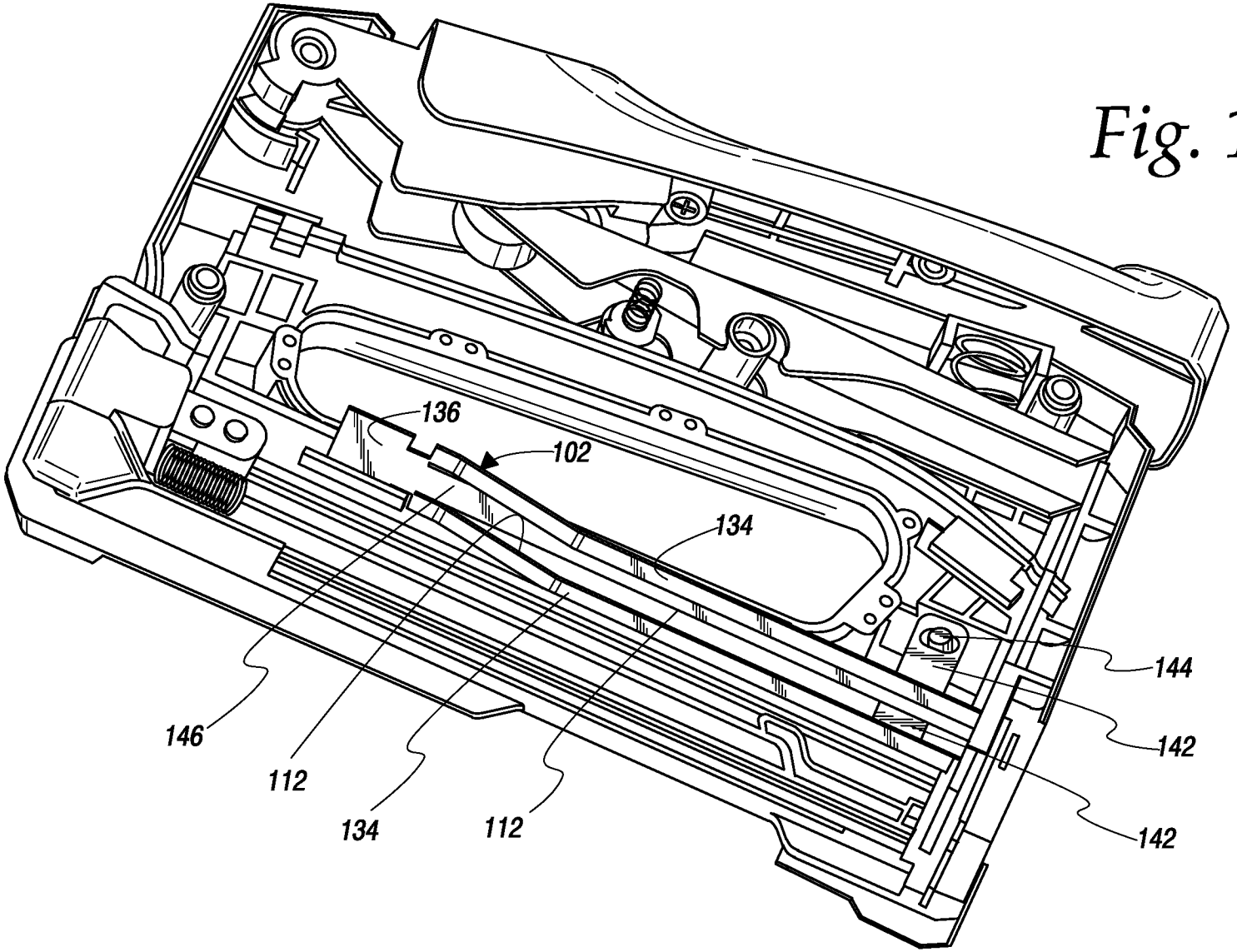
FIG. 13 is a perspective view similar to FIG. 6, but showing an alternate embodiment of the staple guide in the guiding position.
Figure 14:
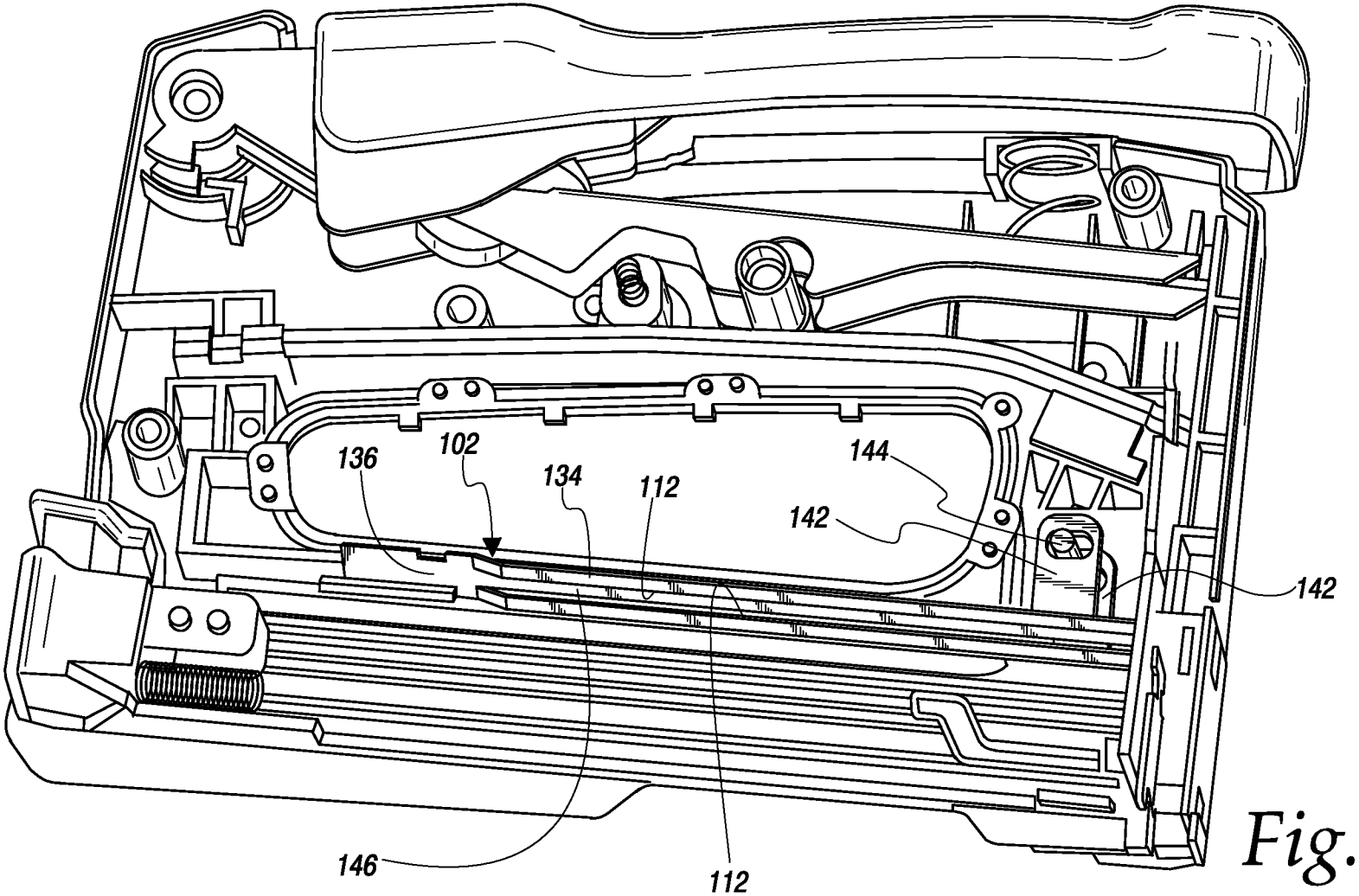
FIG. 14 is a perspective view similar to FIG. 7, but showing the alternate embodiment of the staple guide in the stowed position.
Figure 15:
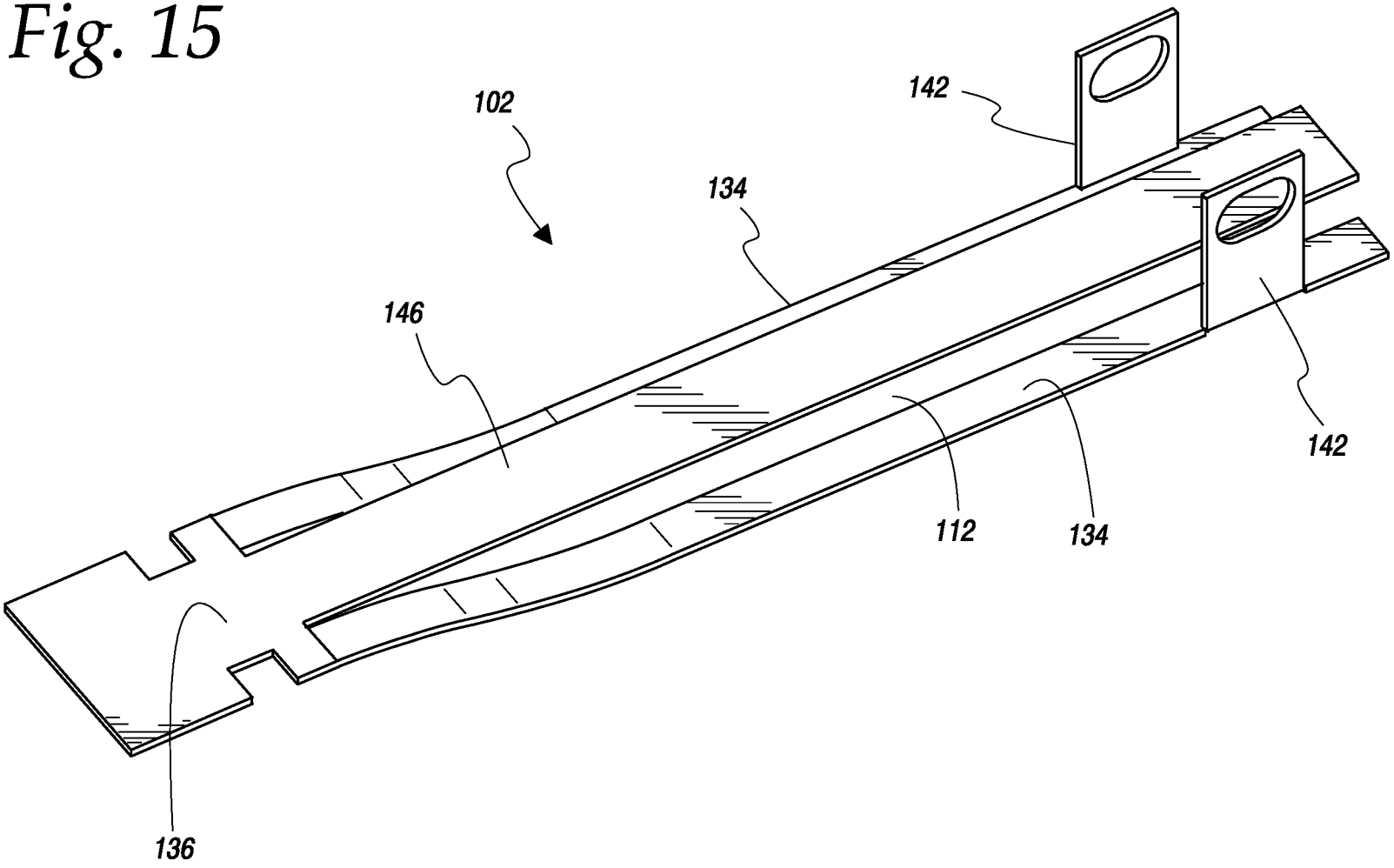
FIG. 15 is a perspective view of the staple guide of FIGS. 13 and 14.

Another embodiment of the staple guide 102 is shown in FIGS. 13-15 wherein each of the legs 134 is a leaf-spring that can be deflected by a user from the guiding position shown in FIG. 13 to the stowed position shown in FIG. 14. In this regard, in the illustrated embodiment, each of the legs 134 include a foot portion 142 that engages a post 144 extending from the slide 100 through the elongate slot 140 in the frame 16. This engagement transmits an actuation force from the slide 100 to the each of the legs 134 to deflect the legs 134 from the guiding position to the stowed position as a user translates the slide 100 from the first position to the second position. The embodiment of FIGS. 13-15 also includes a flat planar support 146 extending from the bridge 136 and located between the legs 134 to engage the frame 16. Any suitable resilient material can be used to form the embodiment of the spring guide 102 shown in FIGS. 13-15, with one example being a suitable sheet of spring steel.

It should be appreciated that the disclosed guide surface 112 and 114 positively guide a collation 24 of staples 12 in the magazine 20 independent of any feature on the track 95, which allows for collations 24 to be inserted and correctly positioned in the magazine 20 without depending on the track 95. This allows for the collations 24A and 24B to be inserted and correctly positioned in the magazine 20 via the opening while the track 95 is in the loading position. In turn, this allows for the track 95 to be retained in the frame in the loading position because the collations 24A and 24B can be inserted into the magazine without requiring that the track 95 be removed from magazine 20 and the frame 16. In this regard, it should further be appreciated that the staple guide 102 can be actuated from its guiding to its stowed position simply by engagement with the collation 24B when the staples 12B contact the legs 134 as the collation 24B is being inserted into the magazine 20 via the opening 99, which allows for embodiments that don't utilize a slide 100 to actuate the staple guide 102 between the guiding and stowed positions and/or don't include a slide 100 as part of the assembled staple gun 10. In such embodiments, the staple guide 102 shown in FIGS. 13-15 will move from the stowed position to the guiding position via the spring bias in the legs 134, and the embodiment of the staple guide 102 shown in FIGS. 1, 2, and 5-11 can be provided with a spring, such as a torsion spring, that biases the legs 134 to the guiding position.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the staple gun 10 are shown in the figures, it should be understood that this disclosure anticipates variations in the specific details of each of the disclosed components and features of the staple gun 10 and that no limitation to a specific form, configuration, or detail is intended unless expressly and specifically recited in an appended claim.

For example, while specific and preferred forms have been shown for the frame 16, the grip 18, the staple driving mechanism 20, and the components 95, 96, 97, and 98, and suitable frame 16, grip 18, staple driving mechanism 20, and components 95, 96, 97, and 98, many of which are known, may be used in connection with the user-actuated unit 24. For example, in some application it may be desirable for the user to actuate the legs 134 from the guiding position to the stowed position by inserting a collation 24B of the staples 12B into the magazine 22 and using the contact of the staples 12B against the legs 134 to force the legs 134 to the stowed position against a spring force, and then to allow the spring force to move the legs 134 from the stowed position to the guiding position when staples 12B are not loaded into the magazine 22. In this regard, for the embodiment of the guide 102 shown in FIG. 1-M, a spring could be engaged between either or both of the legs 134 and the frame 16 to bias the legs 134 to the guiding position. As another example, while the staple guide 102 is shown as being actuated via an operable connection to the slide 100, in some applications it may be desirable to provide other means for actuating the guide between the guiding and the stowed position and to allow the slide 100 and guide 102 to move independent of each other. Additionally, in some applications it may be desirable for the user-actuated unit 24 to only include the slide 100 or the guide 102. As yet another example, while the embodiment of the staple guide 102 shown in Figures x-y utilizes a base material having a uniform, flat, rectangular cross section, other cross-sectional shapes may be used, including cross-sectional shapes that vary throughout the length of the legs 134 and/or the bridge 136. In this regard, for example, a circular cross sectional shape could be utilized for the legs 134. As another example, while a uniform circular cross-sectional shape has been shown for the embodiment of the guide 102 shown in FIG. 1-M, other cross-sectional shapes may be used, including cross-sectional shapes that vary throughout the length of the legs 134 and/or the bridge 136. In this regard, for example, triangular or rectangular cross-sections could be utilized for the legs 134. As yet another example, while both of the illustrated embodiments of the guide 102 have been shown as being formed from a single piece of material, in some embodiment a multiple piece assembly may be desirable and can be used. In a further example, while specific and highly preferred configurations have been shown for the operable connection between the slide 100 and the guide 102, any suitable operable connection can be used to transfer an actuation force from the slide 100 to the guide 102. While the preferred embodiment of the slide 100 show the slide 100 mounted for translation between the first and second slide positions, in some applications it may be desirable for the slide 100 to move in a non-linear fashion, such as pivoting or curvilinear movement, between the first and second positions. Similarly, while a preferred mount configuration has been shown for the slide 100 to the frame 16, other mount configurations can be used to provide the desired movement of the slide between the first and second slide positions. As yet another example, while the guide surfaces/walls 114 have been shown as integral parts of the frame components ZZ and &&, the surfaces/walls 114 can be defined by separate components that are mounted to the components zz and &&.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. A manually operated staple gun configured to carry a collation of staples and sequentially drive each of the staples of the collation in response to user actuation of the staple gun, the staple gun capable of utilizing staples having different widths, the widths defined by a pair of spaced legs on each staple, the staple gun comprising:

a frame;

a staple magazine in the frame selectively configurable to receive a first collation of staples having a first width and a second collation of staples having a second width, the second width being greater than the first width;

a user-actuated staple guide having a first pair of longitudinally extending guide surfaces to guide staples of the first width along a guide axis into a ready position to be driven into a work piece, the staple guide being mounted in the frame to move between a guiding position wherein the guide surfaces guide staples of the first width along the guide axis and a stowed position wherein the guide surfaces do not guide staple along the guide axis; and a second pair of longitudinally extending guide surfaces to guide staples of the second width along the guide axis into the ready position to be driven into a work piece with the staple guide in the stowed position.

2. The staple gun of claim 1 wherein the staple guide is u-shaped with a pair of legs defining the guide surfaces and a bridge joining the legs.

3. The staple gun of claim 2 wherein each of the legs is a leaf-spring that can be deflected by a user from the guiding position to the stowed position.

4. The staple gun of claim 2 wherein the staple guide is pivot mounted to the frame at the bridge and the legs pivot between the guiding and stowed positions.

5. The staple gun of claim 4 wherein the legs and the bridge are defined by a continuous length of cylindrical shaped material.

6. The staple gun of claim 5 wherein the continuous length of material is a metallic wire that has been permanently deformed to define the legs and the bridge.

7. The staple gun of claim 2 further comprising a user-actuated slide mounted to the frame to move between first and second positions, and wherein the staple guide further includes a foot extending from one of the legs and operably engaged with the slide to transmit an actuating force from the slide to the staple guide to actuate the staple guide between the guiding and stowed positions as the slide is moved between the first and second positions.

8. The staple gun of claim 7 wherein the slide is mounted to the frame to translate between the first and second positions and the staple gun further includes a spring-biased detent that engages the slide in the first position to retain the slide in the first position.

9. The staple gun of claim 1 wherein the staple guide is mounted to the frame to pivot between the guiding and stowed positions.

10. The staple gun of claim 9 further comprising a user-actuated slide mounted to the frame to move between first and second positions, the slide operably engaged with the staple guide to transmit an actuating force to pivot the staple guide between the guiding and stowed positions as the slide is moved between the first and second positions.

11. The staple gun of claim 10 wherein the slide is mounted to the frame to translate between the first and second positions.

12. The staple gun of claim 1 further comprising a user-actuated slide mounted to the frame to move between first and second positions, the slide operably engaged with the staple guide to transmit an actuating force to move the staple guide between the guiding and stowed positions as the slide is moved between the first and second positions.

13. The staple gun of claim 12 wherein the slide is mounted to the frame to translate between the first and second positions.

14. The staple gun of claim 1 wherein the second pair of guide surfaces extend parallel to the guide axis and are defined by the frame.

15. The staple gun of claim 1 wherein the first and second pairs of guide surfaces extend parallel to the guide axis.

* * * * *